US011154739B2

(12) United States Patent
Kistner et al.

(10) Patent No.: US 11,154,739 B2
(45) Date of Patent: Oct. 26, 2021

(54) PLYOMETRIC EXERCISE LADDER

(71) Applicants: Louis Robert Kistner, Dover, PA (US); James Shields Matthews, IV, Honolulu, HI (US)

(72) Inventors: Louis Robert Kistner, Dover, PA (US); James Shields Matthews, IV, Honolulu, HI (US)

( * ) Notice: Subject to any disclaimer, the term of this patent is extended or adjusted under 35 U.S.C. 154(b) by 0 days.

(21) Appl. No.: 15/998,045

(22) Filed: Jun. 16, 2018

(65) Prior Publication Data

US 2020/0197737 A1 Jun. 25, 2020

(51) Int. Cl.

| | |
|---|---|
| ***A63B 1/00*** | (2006.01) |
| ***A63B 23/12*** | (2006.01) |
| ***A63B 23/035*** | (2006.01) |
| ***A63B 24/00*** | (2006.01) |
| ***A63B 21/005*** | (2006.01) |
| ***A63B 21/00*** | (2006.01) |

(Continued)

(52) U.S. Cl.

CPC ..... *A63B 1/005* (2013.01); *A63B 21/0052* (2013.01); *A63B 21/0058* (2013.01); *A63B 21/169* (2015.10); *A63B 21/4034* (2015.10); *A63B 21/4035* (2015.10); *A63B 23/03525* (2013.01); *A63B 23/1218* (2013.01); *A63B 24/0087* (2013.01); *A63B 2071/0072* (2013.01); *A63B 2220/62* (2013.01); *A63B 2220/89* (2013.01); *A63B 2225/093* (2013.01)

(58) Field of Classification Search

CPC ..... A63B 1/005; A63B 23/1218; A63B 23/03525; A63B 24/0087; A63B 21/0052; A63B 21/0058; A63B 21/4035; A63B 21/4034; A63B 21/169; A63B 2220/62; A63B 2225/093; A63B 2071/0072; A63B 2220/89; A63B 71/023; A63B 2209/00; A63B 2209/08; A63B 2210/50; A63B 2220/17; A63B 2220/833; A63B 2225/09; A63B 71/0054; A63B 17/00; A63B 5/02

See application file for complete search history.

(56) References Cited

U.S. PATENT DOCUMENTS 2,042,764 A * 6/1936 Erastus ..... A63B 22/001 482/52
4,298,092 A * 11/1981 Eriksson ..... E06C 9/14 182/196

(Continued)

*Primary Examiner* — Garrett K Atkinson
(74) *Attorney, Agent, or Firm* — Block 45 Legal, LLC

(57) ABSTRACT

A plyometric exercise ladder. A frame has two, spaced-apart, upright posts. A fixed arm is mounted to each upright post, each fixed arm being adjustable along the length of the frame. A removable pull-up bar is supported by the fixed arms. Two spring-loaded arms disposed above the fixed arms are pivotally mounted to the upright posts of the frame. An electromagnet is connected to each spring-loaded arm for initiating movement. A freestanding bracket having at least one scissor arm is connected to the frame and to a wall or other solid structure to support the ladder. In place of the spring-loaded arms and electromagnet, a set of pegs can be removably placed along the length of the upright posts for retaining the pull-up bar as an athlete progresses upwardly. The ladder frame itself can be replaced with a skeletal frame when the ladder is used in conjunction with a conventional squat rack.

7 Claims, 14 Drawing Sheets

(51) Int. Cl.
*A63B 21/16* (2006.01)
*A63B 71/00* (2006.01)

(56) References Cited

U.S. PATENT DOCUMENTS 4,478,549 A * 10/1984 Stelly ..... B65G 69/30 182/104
4,822,029 A * 4/1989 Sarno ..... A63B 22/0002 482/120
4,848,737 A * 7/1989 Ehrenfield ..... A63B 21/157 482/52
4,923,191 A * 5/1990 Persico ..... A63B 22/001 482/52
4,982,957 A * 1/1991 Shields ..... A63B 71/0036 482/104
5,066,001 A * 11/1991 Wilkinson ..... A63B 21/4037 482/52
5,112,043 A * 5/1992 Gilfillian, Jr. ..... A63B 22/001 482/37
5,145,472 A * 9/1992 Johnson, III ..... A63B 23/12 482/119
5,145,475 A * 9/1992 Cares ..... A63B 21/157 482/52
5,281,193 A * 1/1994 Colbo, Jr. ..... A63B 21/078 482/104
5,328,422 A * 7/1994 Nichols ..... A63B 22/001 482/111
5,605,205 A * 2/1997 Douglas ..... E06C 1/56 182/198
5,746,287 A * 5/1998 Durham, Jr. ..... A62B 5/00 182/196
5,971,105 A * 10/1999 Jacobson ..... E06C 1/525 182/196
6,447,427 B1 * 9/2002 Myrland ..... A63B 23/0464 482/14
6,475,116 B2 * 11/2002 Wu ..... A63K 3/043 482/14
6,945,360 B2 * 9/2005 Sullivan, Jr. ..... E04G 1/28 182/151
6,955,631 B2 * 10/2005 Wu ..... A63B 23/0464 182/196
7,645,211 B1 * 1/2010 Thomeczek ..... A63B 69/0053 482/1
7,815,555 B2 * 10/2010 Webber ..... A63B 21/0618 482/104
7,841,957 B1 * 11/2010 Wares ..... A63B 69/0071 473/433
7,874,959 B2 * 1/2011 Dieter ..... A63B 23/0464 482/51
8,070,656 B2 * 12/2011 Dieter ..... A63B 69/0028 482/51
8,317,661 B2 * 11/2012 Wight ..... A63B 23/0464 482/38
8,328,696 B2 * 12/2012 Dieter ..... A63B 23/0464 482/51
8,517,900 B1 * 8/2013 Britt ..... A63B 21/0628 482/104
8,574,133 B2 * 11/2013 Dieter ..... A63B 69/0028 482/51
8,834,332 B2 * 9/2014 Campanaro ..... A63B 21/00072 482/142
9,011,298 B2 * 4/2015 Bonomi ..... A63B 21/0414 482/101
9,017,224 B1 * 4/2015 Singley ..... A63B 22/0023 482/52
9,421,409 B2 * 8/2016 Sann ..... A63B 1/00
9,440,132 B2 * 9/2016 Brewer ..... A63B 69/0048
9,675,830 B2 * 6/2017 Holland ..... A61H 15/00
10,065,060 B2 * 9/2018 Simmons ..... A63B 23/03575
10,245,461 B2 * 4/2019 Bruni ..... A63B 21/4035
10,864,401 B2 * 12/2020 Schween ..... A63B 1/00
10,953,301 B2 * 3/2021 Brasch ..... A63B 71/0036
2003/0134722 A1 * 7/2003 Greenland ..... A63B 21/078 482/100
2006/0247100 A1 * 11/2006 Harker ..... A63B 5/16 482/23
2007/0042876 A1 * 2/2007 Lundquist ..... A63B 21/0783 482/94
2011/0166000 A1 * 7/2011 Wight ..... A63B 23/0464 482/17
2014/0128228 A1 * 5/2014 Bonomi ..... A63B 23/03525 482/98
2016/0074687 A1 * 3/2016 Sann ..... B62D 63/08 482/35
2017/0246523 A1 * 8/2017 Holland ..... E06C 1/12
2017/0252594 A1 * 9/2017 McKenna ..... A63B 3/00

* cited by examiner

PLYOMETRIC EXERCISE LADDER

RELATED PATENT APPLICATION

The present application is related to provisional patent application No. 62/595,695 for COMPACT LADDER WITH ELECTROMAGNETIC ACTUATED FIXED ARM filed Dec. 7, 2017, and hereby incorporates the teaching therein by reference.

FIELD OF THE INVENTION

This invention relates to exercise equipment and, more particularly, to a plyometric ladder for exercising.

BACKGROUND OF THE INVENTION

The original version of plyometrics, created by Russian scientist Yuri Verkhoshansky in the late 1960s, is also known as the shock or impact method or "jump training." Verkhoshansky, known colloquially as "the father of plyometrics," studied the actions that occur in running and jumping. He found that the landings and takeoffs in these two skills involved high ground reaction forces that were executed extremely quickly. He attempted to duplicate these explosive forces in exercises.

Plyometric exercises activate the quick response and elastic properties of the major muscles in the body, the muscles exerting maximum force in short intervals of time to increase an athlete's speed, quickness, and power after development of a strong strength base. The muscles contract quicker when engaging in plyometric exercises than they normally do. The athlete moves from a muscle extension to a contraction rapidly, such as in specialized repeated jumping.

When an athlete drops down from a height and experiences a shock upon landing, his muscles result in a forced eccentric contraction which is almost immediately switched to a concentric contraction as the athlete jumps upwardly. The landing and takeoff are executed in a very short period of time, in the range of tenths of a second. In the so-called depth jump, the athlete's hip, knee, and ankle extensor muscles undergo a powerful eccentric contraction. For the muscles to respond explosively, the eccentric contraction then quickly converts to isometric and then concentric contraction. Traditional cardio training can help with speed and stamina, but adding plyometric jump drills helps to add an extra burst of quickness to the athlete's jump, allowing him to jump as high as possible.

In the eccentric contraction, the muscles are involuntarily lengthened, while in the concentric contraction, the muscles are shortened after being tensed. Most of the stretching and shortening takes place in the tendons that attach to the muscles involved rather than in the muscles. While the body is dropping, the athlete consciously prepares the muscles for the impact by tensing the muscles. Upon making contact with the floor or ground, he then goes into slight leg flex to absorb some of the force. The muscles and tendons withstand the force that is experienced in the landing. This force is withstood in eccentric contraction. When muscle contraction is sufficiently great, it is able to stop the downward movement very quickly.

Plyometrics are used by athletes, especially martial artists, sprinters, and high jumpers, to improve performance. Sports using plyometrics include football, basketball, tennis, badminton, squash, volleyball, and any sport that involves the use of explosive movements.

A version of plyometrics, seen to a great extent in the United States, relates to doing any form of jump regardless of execution time. The intensity of execution is much lower and the time required for transitioning from the eccentric to the concentric contraction is greater.

DESCRIPTION OF RELATED ART

U.S. Pat. No. 6,172,657 issued to Monterrey for EXERCISE APPARATUS TO ENHANCE MUSCLE RECRUITMENT OF A USER THROUGH ISOMETRIC AND PLYOMETRIC MOVEMENTS issued on Nov. 14, 2017, describes an exercise apparatus to enhance muscle recruitment of a user that includes a base platform, a rotatable shaft coupled to the base platform, a brake assembly coupled to the base platform and operably connected to the rotatable shaft, the brake assembly having a controller designed to engage and disengage the brake assembly from the rotatable shaft, and a pair of cables with first ends coupled to the rotatable shaft and second ends coupled to a bar. The controller engages the brake assembly with the rotatable shaft to lock the rotatable shaft in a stationary position for a predetermined time to permit the user to perform an isometric movement with the bar. The controller disengages the brake assembly from the rotatable shaft after the predetermined time to permit the rotatable shaft to rotate to permit the user to perform a plyometric movement with the bar.

U.S. published patent application No. 2014/0213414 on application filed by Balandis, et al. for MULTI FUNCTION EXERCISE APPARATUS WITH RESISTANCE MECHANISM, published on Jul. 31, 2014, describes an exercise apparatus that provides multiple different exercises for a user, including both resistance movements and isometrics. The user interacts with the apparatus by grasping a bar. A resistance mechanism is symmetrically mounted on a second bar and provides infinitely variable resistance to the user, as well as soundproof operation. A vertical column allows infinite positioning of the bars for different bodily exercises, and a bench for support. The user can change the exercise resistance by verbal commands, or the apparatus can vary the exercise resistance in response to the force applied by the user. The apparatus can be operated at locations where electric service is permanently unavailable, or in zero gravity; and the apparatus can be mounted inside a shallow closet and hidden from view. To verify accuracy, the resistance can be calibrated against a known quantity of weight.

SUMMARY OF THE INVENTION

In accordance with the present invention, there is provided a plyometric exercise ladder. A frame has two, spaced-apart, upright posts. A fixed arm is mounted to each upright post, each fixed arm being adjustable along the length of the frame. A removable pull-up bar is supported by the fixed arms. Two spring-loaded arms disposed above the fixed arms are pivotally mounted to the upright posts of the frame. An electromagnet is connected to each spring-loaded arm for initiating movement. A freestanding bracket having at least one scissor arm is connected to the frame and to a wall or other solid structure to support the ladder. In place of the spring-loaded arms and electromagnet, a set of pegs can be removably placed along the length of the upright posts for retaining the pull-up bar as an athlete progresses upwardly. The ladder frame itself can be eliminated when the ladder is used in conjunction with a conventional squat rack.

It is therefore an object of the invention to provide a plyometric exercise ladder.

It is a further object of the present invention to provide a plyometric exercise ladder having a removable pull-up bar supported by adjustable fixed arms.

It is a further object of the present invention to provide a plyometric exercise ladder having spring-loaded, pivotal arms for receiving and releasing the pull-up bar as an athlete ascends the ladder.

It is still a further object of the present invention to provide a plyometric exercise ladder having an electromagnet or motor for activating the spring-loaded pivotal arms.

It is a further object of the present invention to provide a plyometric exercise ladder alternatively having a series of removable pegs at an acute angle relative to a frame or skeletal frame for receiving the pull-up bar as an athlete ascends the ladder.

These and other objects and advantages of the present invention are more readily apparent with reference to the following detailed description and the accompanying drawings.

BRIEF DESCRIPTION OF THE DRAWINGS

A complete understanding of the present invention may be obtained by reference to the accompanying drawings, when considered in conjunction with the subsequent detailed description, in which.

Like reference numerals refer to like parts throughout the several views of the drawings.

DETAILED DESCRIPTION OF THE EMBODIMENTS

Figure 1:
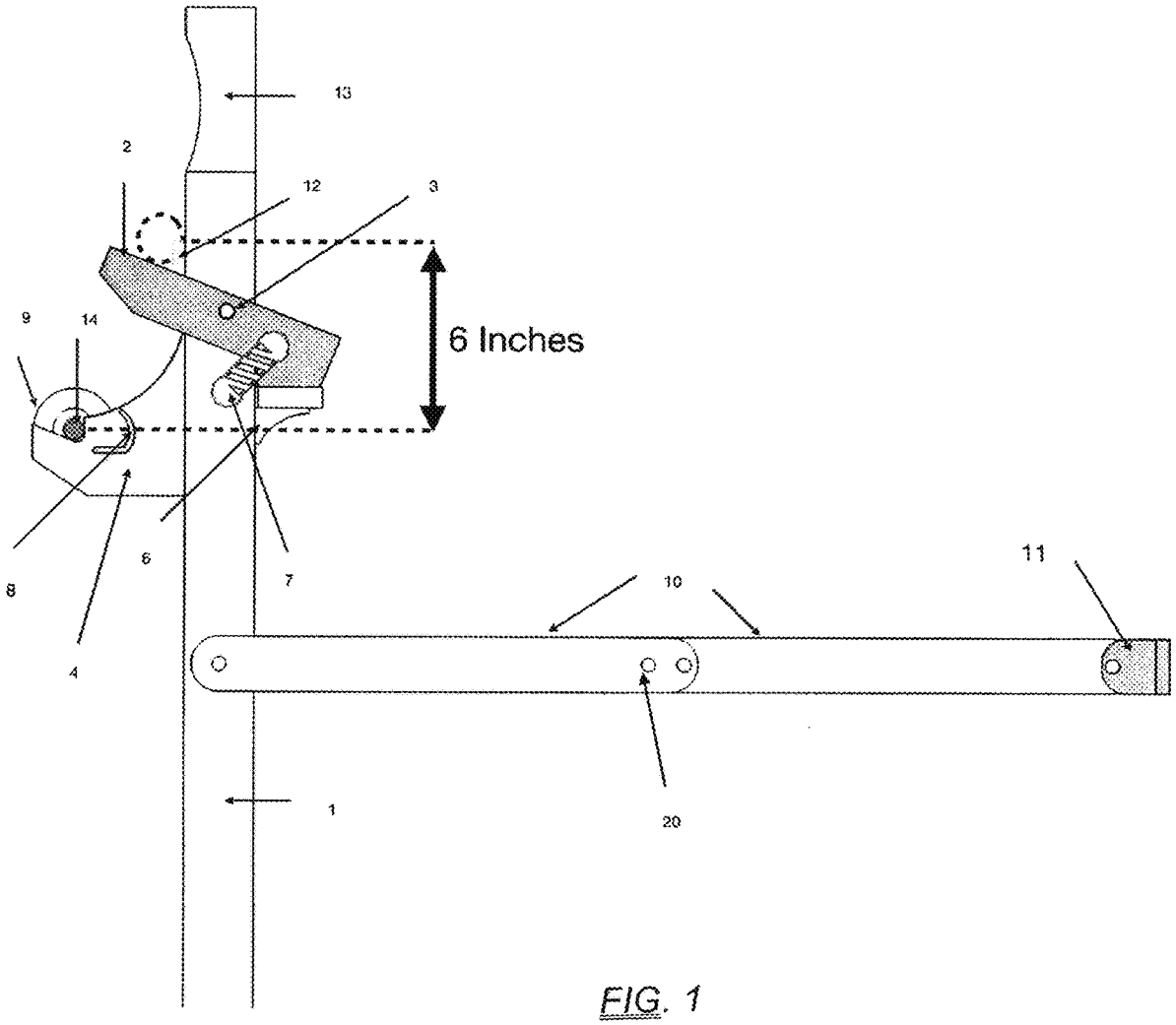
FIG. 1 is a side view of one embodiment of the plyometric exercise ladder in accordance with the present invention.

Although the following detailed description contains specific details for the purposes of illustration, those of ordinary skill in the art will appreciate that variations and alterations to the following details are within the scope of the invention. Accordingly, the exemplary embodiments of the invention described below are set forth without any loss of generality to, and without imposing limitations upon, the claimed invention.

A plyometric exercise ladder has a frame with two, spaced-apart, upright posts. A fixed arm is mounted to each upright post, each fixed arm being adjustable along the length of the frame. A removable pull-up bar is supported by the fixed arms. Two spring-loaded arms disposed above the fixed arms are pivotally mounted to the upright posts of the frame. In place of the spring-loaded arms, a set of pegs can be removably placed along the length of the upright posts for retaining the pull-up bar as an athlete progresses upwardly. The ladder frame itself can be eliminated when the ladder is used in conjunction with a conventional squat rack.

The inventive plyometric exercise ladder is a pull-up stand. The primary concept is to take a traditional pull-up exercise and make it more difficult by allowing the athlete to "jump" the pull-up bar vertically to prepositioned pegs. A key feature of this invention is that it allows for an athlete to make multiple vertical jumps even in spaces with very limited vertical space. Another key feature of the invention is that athletes are making jumps at a safer height than other, more extreme pull-up ladders.

In the first embodiment, a fixed arm can be adjusted for a smaller or larger hop depending on the desired challenge for the athlete. In other embodiments, a bar can be locked for more traditional pull-up exercises.

In other embodiments, additional components can be added to the basic frame to change the nature of the exercise. For example, the athlete can use a bar that accommodates gravity boots or he can use a rotating track for a rotating peg board.

Another embodiment of the invention is a 12-foot version of the plyometric ladder, discussed in greater detail hereinbelow.

In all embodiments, there are three ways to attach the frame to a solid structure such as a wall, tree, deck, existing squat rack, etc. In the one embodiment, scissor arms and wall brackets are used. The scissor arms enable the ladder to be stored closer to a wall when not in use. A fixed bracket holds the ladder to a wall mounting bracket and provides stability and sturdiness to the ladder. Alternatively, fixed brackets and wall brackets can be used but a frame is stationary. And in yet another embodiment, no frame is provided at all, so the unit can be used in conjunction with a commercial squat rack.

In operation, an athlete performs a pull-up and then hops the bar up while hanging from the bar an adjustable distance, hangs for an adjustable time, then a spring-loaded arm pivots and releases the athlete to ride down a fixed arm to the starting point to begin the cycle again. More advanced athletes may use the removable pegs 16 in the 12-foot embodiment instead of the adjustable fixed arm to increase difficulty.

In accomplishing this, the invention utilizes several safety features that minimize risk of user injury. First, a safety backstop is built into the adjustable fixed arm to keep the athlete stationary before the jump, and it keeps the athlete from coming off the adjustable fixed arm on the ride down the ellipse. Second, the bar has a safety leash to keep the bar from detaching from the ladder in case the athlete loses balance on the jump. Finally, an adjustable safety backstop is positioned on top of the frame to keep the athlete from moving the pull-up bar over the upper frame if the athlete has an out of control jump.

The plyometric ladder is created in such a way that dismantling the apparatus is simple and allows for efficient set up and shipping of the device to customers. This feature also allows owners of the invention the ability to move the ladder from one location to another quickly. As an example of this efficient design, a 12-foot ladder can be shipped in two six-foot sections. When the customer receives the ladder, he can assemble the two sections and mount the assembled ladder to any sturdy structure. The frame is drilled at regular six-inch intervals to allow the customer to insert the removable pegs in six, twelve, or eighteen-inch positions for variable difficulty.

Referring now to FIG. 1, there is shown a side view of the plyometric exercise ladder in accordance with the present invention, illustrating the position of two adjustable fixed arms 4 in relation to two corresponding spring-loaded arms 2. An electromagnet 6 holds the spring-loaded arms 2 until it cycles off Additionally, two respective axles 3 hold the spring-loaded arms 2 to the ladder frame 1. The axles 3 protrude though the frame 1, the spring-loaded arms 2, and the adjustable fixed arms 4, providing pivot points for the spring-loaded arms 2 and serving to attach the spring-loaded arms 2 to the frame 1.

A pull-up bar 14 rests on the adjustable fixed arms 4. The pull-up bar 14 is held by the athlete who hops from the adjustable fixed arms 4 to the spring-loaded arms 2. The pull-up bar 14 has adjustable grips 9 for the comfort of the athlete. A locking lever 8 is locked to the pull-up bar 9 for traditional pull-up exercises. Finally, an adjustable safety backstop 13 is located above the frame 1, protecting the athlete from moving the pull-up bar 14 over the frame 1 if he misjudges the distance.

The frame 1 in the first embodiment is composed primarily of a rigid material with a substantially square steel frame. The frame 1 supports the other components of the ladder and attaches to a wall using scissor arms 10. Each upright member of the frame 1 supports an adjustable fixed arm 4, a spring-loaded arm 2, an axle 3, adjustable foot pegs 5, and an adjustable safety backstop 13. In the first embodiment, the ladder stands upright on two 2.5 inch square metal frames and stands eight and one-half feet tall. This set of dimensions is one of many that can be used in other embodiments of the invention. In the first embodiment, the frame 1 is made of mild square tube steel, but in other embodiments, the frame 1 can be made from any rigid and structurally sound material. The frame 1 can be configured as a 12-foot embodiment, and can also be configured to hold attachments to enhance or change the manner of exercise, such as a hanging hand crank, a rotating peg board, gravity boots for upside down sit-ups, etc.

Each spring-loaded arm 2 is attached using the axle 3 by a clearance hole in the respective spring-loaded arm 2. The axle 3 has a threaded end which holds the spring-loaded arm 2 in place while still letting it pivot. The spring-loaded arm 2 pivots on the axle 3, lowering the pull-up bar 14 back on to the adjustable fixed arm 4. The spring-loaded arm 2 can be used instead of, but not in addition to, removable pegs.

Each adjustable fixed arm 4 has a proprietary elliptical shape and material to reduce the amount of moving parts while the proprietary ellipse shape facilitates a smooth ride for the athlete. The ellipse shape provides a gentle, sloping motion as opposed to an abrupt fall or hard radius. The adjustable fixed arm 4 has multiple functions:

a) it serves as a resting point for the pull-up bar 14 and jumping off point for the athlete;
b) it has a built-in backstop part of the proprietary shape so the athlete does not move the pull-up bar 14 off of the front of the adjustable fixed arm 4; and
c) it is adjustable so the athlete can increase the jumping distance and height for a greater challenge.

In the first embodiment of the invention, the adjustable fixed arms 4 are made of high-density polyethylene (HDPE) and have a "V" shape formed in them to serve as the initial point for the pull-up bar 14 to rest. Each fixed arm 4 is adjustable for a six to twelve inch jump to give the athlete more of a challenge as the athlete gets stronger. In other embodiments, the fixed arms 4 can be made of any rigid material that can support up to 250 lbs and are configured for any jump up to 18 inches. In the first embodiment, the fixed arms 4 are made of HDPE for noise and vibration reduction and to aid in manufacturing. The special shape allows for a smooth ride back down with the built-in backstop 13. The HDPE material aids in manufacturing because it is easy to cut or form, and in this embodiment, it is made from a single piece of material. HDPE aids in noise and vibration dampening because it absorbs impacts, unlike steel. The backstop 13 is provided so the athlete cannot move the pull-up bar 14 off the front of the adjustable fixed arms 4. In other embodiments, the adjustable fixed arms 4 can be made from any noise and vibration dampening, rigid material.

Figure 2:
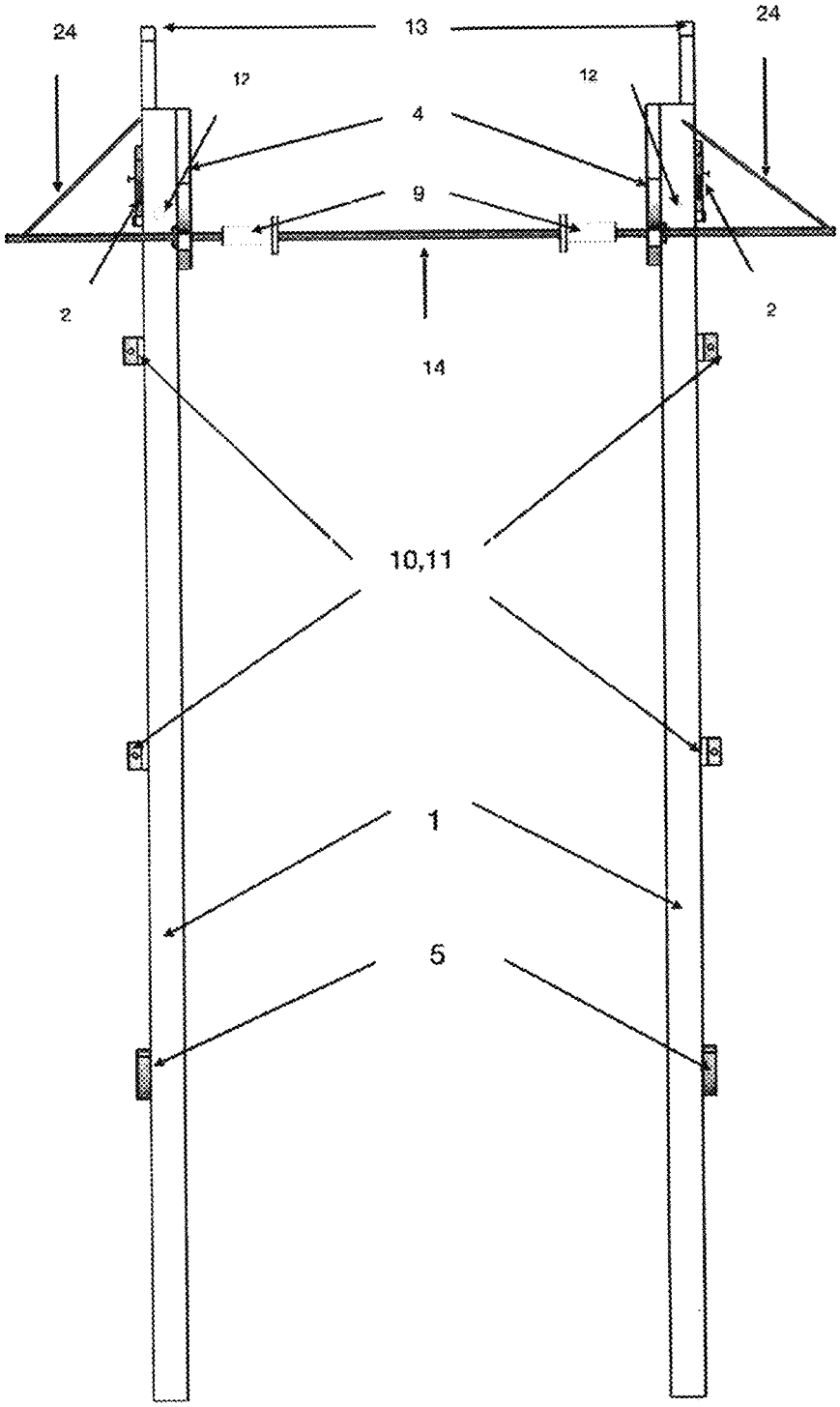
FIG. 2 is a front view of the ladder shown in FIG. 1.

Referring now to FIG. 2, a front view of the invention shows how the preferred embodiment appears to the athlete as he uses the ladder. This view shows the relationship between the two upright sides or posts of the frame 1 and the pull-up bar 14 as well as the position of adjustable grips 9 which are mounted on the pull-up bar 14 and made of a soft, tactile material similar to bicycle grips. Grips 9 are adjustable to the left and right for the preferred grip position of the individual athlete.

The adjustable fixed arms 4 and the spring-loaded arms 2 are positioned on the frame 1 as shown. Additionally, the adjustable safety backstops 13 and the pull-up bar 14 are shown. The adjustable safety backstops 13 slide the athlete back to the spring-loaded arm 2 when necessary, and use a pin and locking device to increase or decrease the height depending on the height of the ceiling. The pin and locking device can raise or lower the backstop 13 by increments of one inch. Other embodiments can include an infinite number of adjustments using a dial, not shown, but well known to those of skill in the art. Finally, a safety leash 24 also attaches to the pull-up bar 14 and the frame 1. The safety leash 24 is made from a high strength but flexible material. In this first embodiment, the safety leash 24 is made from a steel cable. The safety leash 22 keeps the pull-up bar 14 attached to the frame 1 in case the athlete misjudges the jump and loses balance. With the safety leash 24 attached, the pull-up bar 14 cannot fall on the athlete.

Adjustable foot pegs 5 are made of a proprietary ellipse shape and material to reduce the amount of moving parts and increase standing traction for the athlete. The proprietary ellipse shape cradles the foot and naturally slides it towards the frame 1, locking it in place. The proprietary ellipse shape can also be made from a single piece of material to aid in manufacturing. The adjustable foot pegs 5 use a pin and locking device to increase or decrease the help an athlete needs to reach the bar 14. The pin and locking device increase the speed in setting the height for the adjustable foot pegs 5 because the athlete can set it for his individual height, then use the pin to lock it into place. Adjustments can be made of 6, 12, and 18 inches. Other embodiments, of course, can include an infinite number of adjustments using a dial, not shown, but well known to those with skill in the art.

Figure 3:
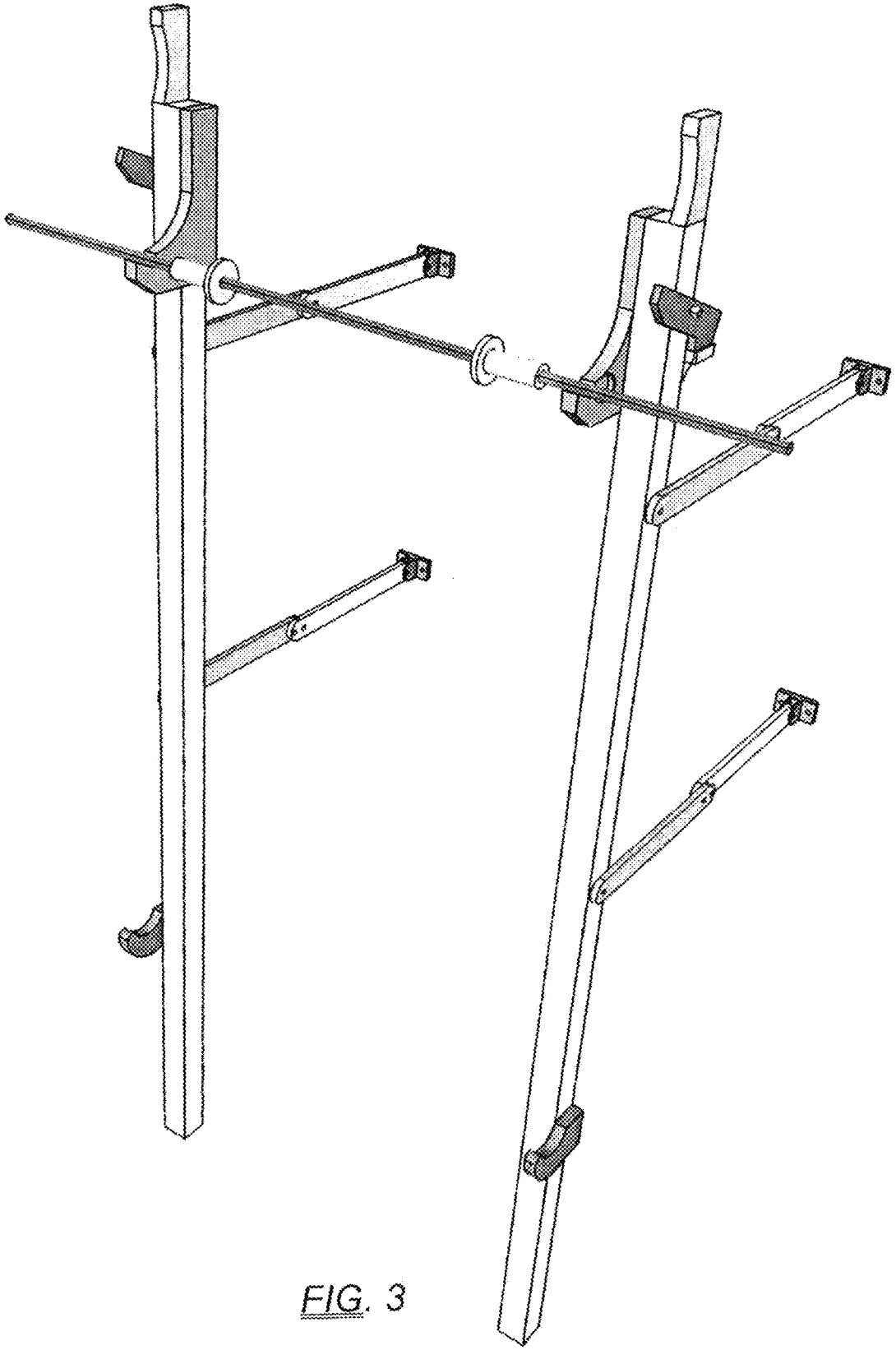
FIG. 3 is a perspective view of the ladder shown in FIGS. 1 and 2.

Referring now to FIG. 3, a perspective view of the invention is shown. This is a three-quarter top down view to show the relationship of all parts and their relative location on the first embodiment.

Figure 4:
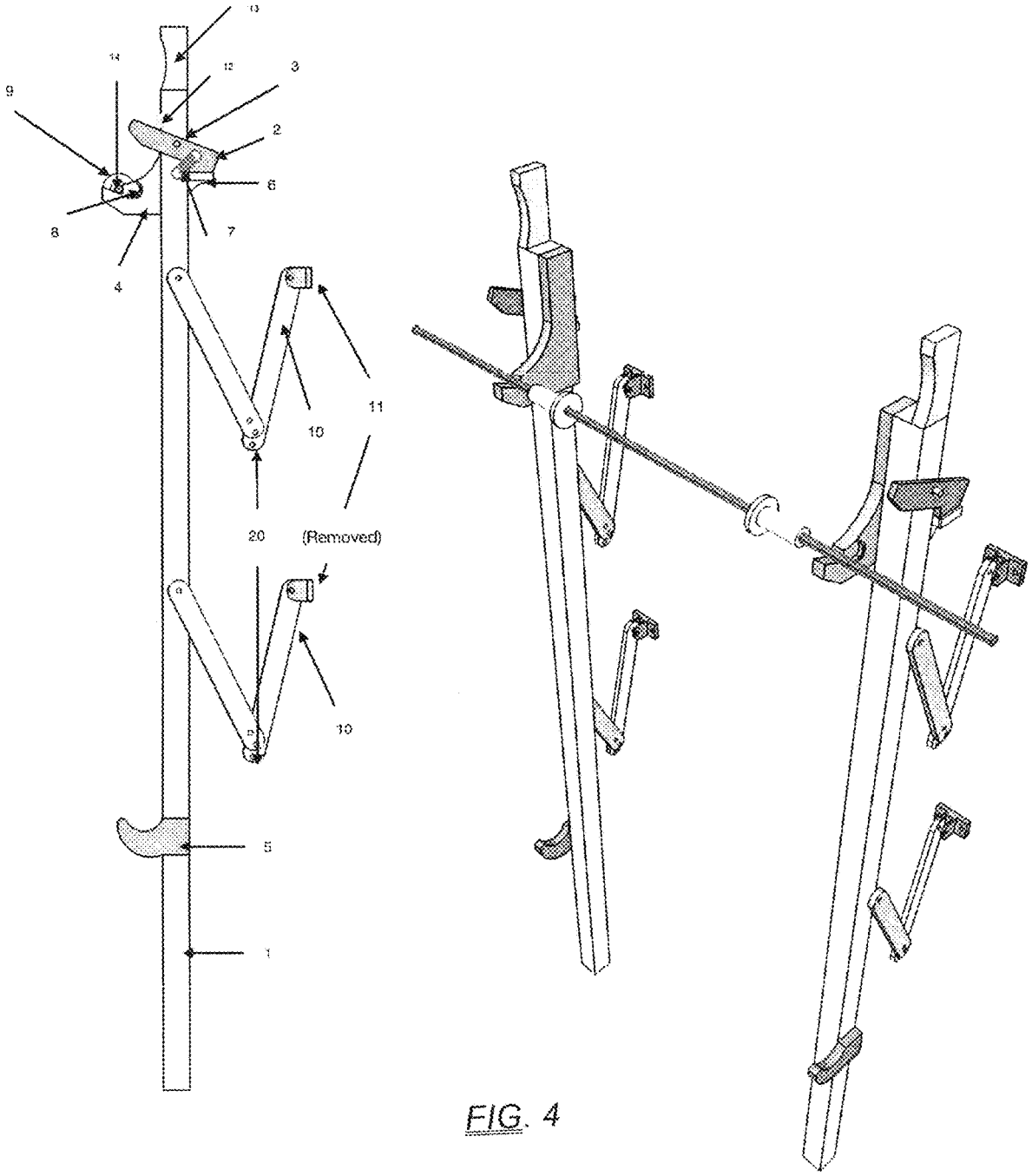
FIG. 4 depicts side and perspective views of the first embodiment of the invention.

Referring now to FIG. 4, a side view and a perspective view of the first embodiment is shown with the scissor arms 10 folded for easy storage closer to the object to which they are mounted. The mounting object is typically a wall, but can also be any large sturdy structure, such as a tree or deck. In this view, cotter pins 20 have been removed from the scissor arms 10, which are folded in towards each other to move the ladder closer towards a wall.

An electromagnet 6 is used to hold each spring-loaded arm 2 in place as the athlete hops the bar 14 onto the spring-loaded arm 2. When the athlete is on the spring-loaded arm 2, a sensor 12 is tripped, the power is turned off, the spring-loaded arm 2 pivots on the axle 3, and drops the athlete back onto the adjustable fixed arm 4. Each electromagnet 6 is rated to hold in excess of 150 lbs, giving it a combined rating of more than 300 lbs. The electromagnet 6 makes contact with the spring-loaded arm 2 with a square piece of metal that extends 90 degrees from the back thereof. The electromagnet 6 aides in manufacturing because it is an inexpensive, off the shelf product that works 100% of the time with no moving parts.

An adjustable spring 7 attaches to the frame 1 and the spring-loaded arm 2. After the spring-loaded arm 2 pivots and drops the athlete back to his starting position, the adjustable spring 7 returns the spring-loaded arm 2 to its start position. Each spring 7 has a rating of 20 lbs and, in this embodiment, is attached to the frame 1 with an adjustable connector to raise or lower the tension. The tension can be adjusted for a lighter or heavier athlete or for personal preference.

A locking lever 8 rotates on the adjustable fixed frame 4 and locks the pull-up bar 14 in place for standard pull-up exercises. The locking lever 8 also locks in accessory specialty bars for the ladder.

As mentioned hereinabove, supporting the frame 1 to a wall are four scissor arms 10. The ladder can also be mounted to wall studs, the side of a house, the side of a deck, or any rigid structure. The scissor arms 10 serve two purposes. The primary purpose is to act as a bracket to hold the frame 1 upright on the floor. The second purpose is to fold the entire unit to the wall, and then into position to use for the exercise.

The scissor arms 10 are hinged and collapse with the help of hinged, wall mounting brackets 11. Wall mounting brackets 11 are bolted directly into the wall stud or a 2×4 cross member using heavy duty lag bolts, not shown. With the scissor arms 10 folded, the ladder folds within a foot of a proximate wall to take up less space. The scissor arms 10 mount to the frame 1 on one side and the wall bracket 11 on the other. The scissor arms 10 pivot on the frame 1, pivot together in the center of the arm, and pivot again at the wall bracket 11, locking in the open position using the removable, locking cotter pins 20.

A reed field sensor 12 is a standard field sensor that is mounted where the frame 1 and spring-loaded arm 2 meet. The reed field sensor 12 senses the proximity of the pull-up bar 14 after the athlete has completed the hop to the spring-loaded arm 2. The pull-up bar 14 trips the reed field sensor 12, which sends an electrical signal to a timer 15, which is an electronic circuit inside a circuit box on or inside the frame 1. The timer 15 waits one second, then cuts power to the electromagnet 6, then counts back to one second and restores power to the electromagnet 6, finishing the cycle.

Figure 5:
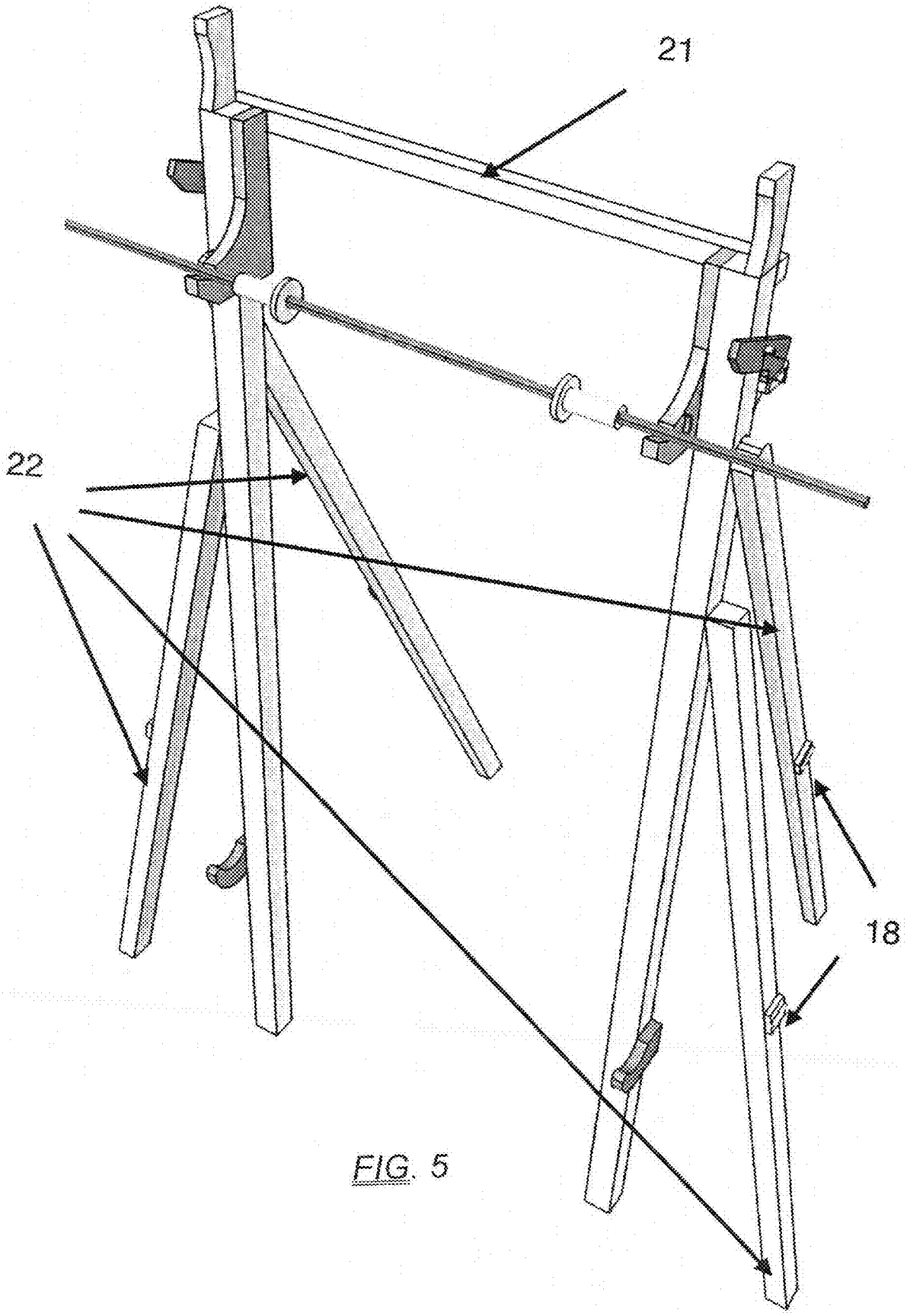
FIG. 5 is perspective view of the plyometric ladder using freestanding brackets.

Referring now to FIG. 5, a perspective view of the invention is shown. Using the freestanding brackets 22, the ladder can be quickly assembled in a freestanding position without a wall or sturdy structure. The freestanding brackets 22 use a locking hinge 18 so the freestanding brackets 22 can fold and unfold easily for transport and assembly. The locking hinge 18 employs a metal tab to prevent the freestanding brackets 22 from inadvertently folding while the athlete is using the ladder, thereby increasing safety.

Figure 6:
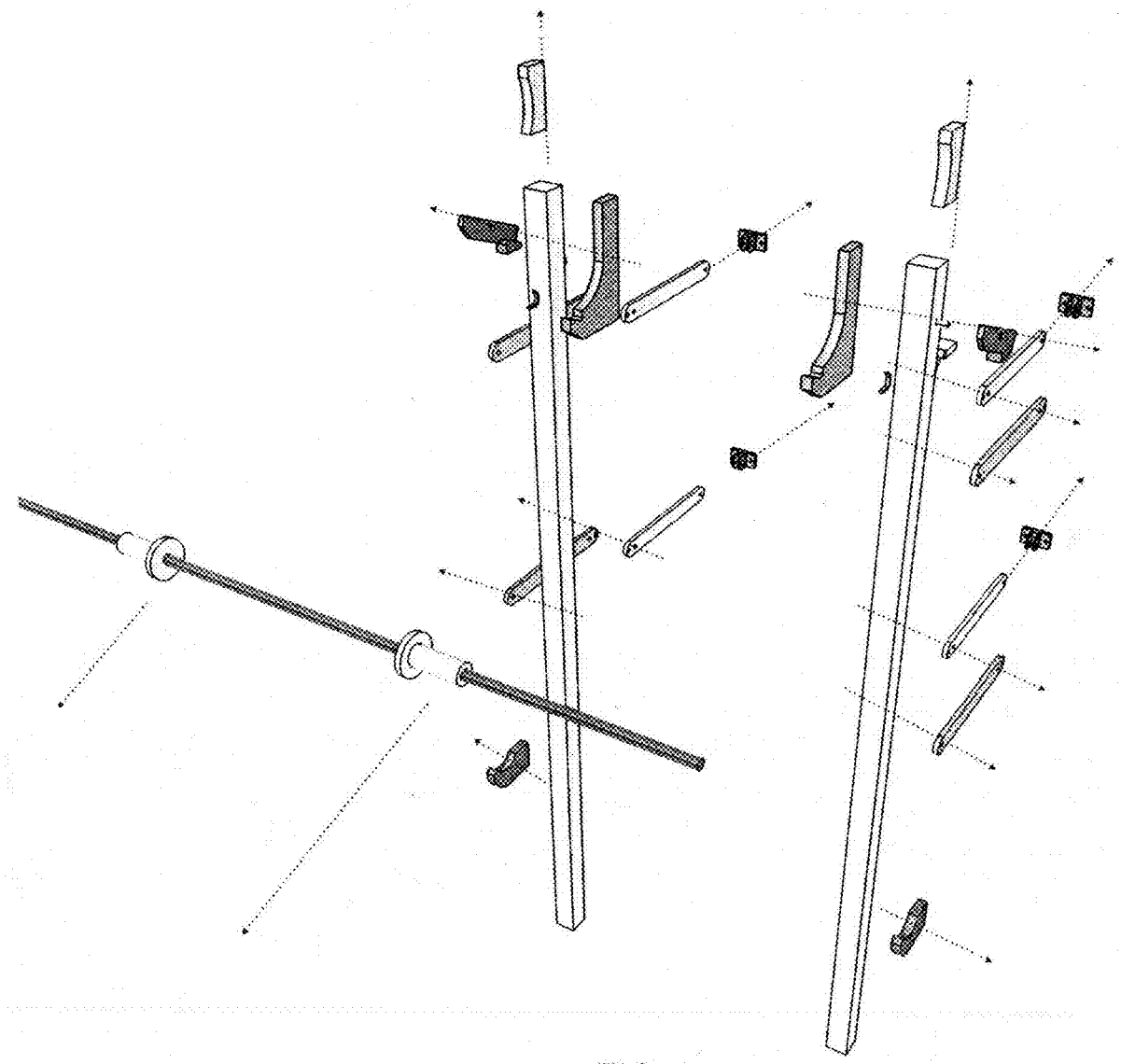
FIG. 6 is an exploded isometric view of the plyometric ladder.

Referring now to FIG. 6, an exploded perspective view of the invention is shown. This three-quarter top down exploded view shows the assembly of the first embodiment and how it is assembled onto the frame 1.

Figure 7:
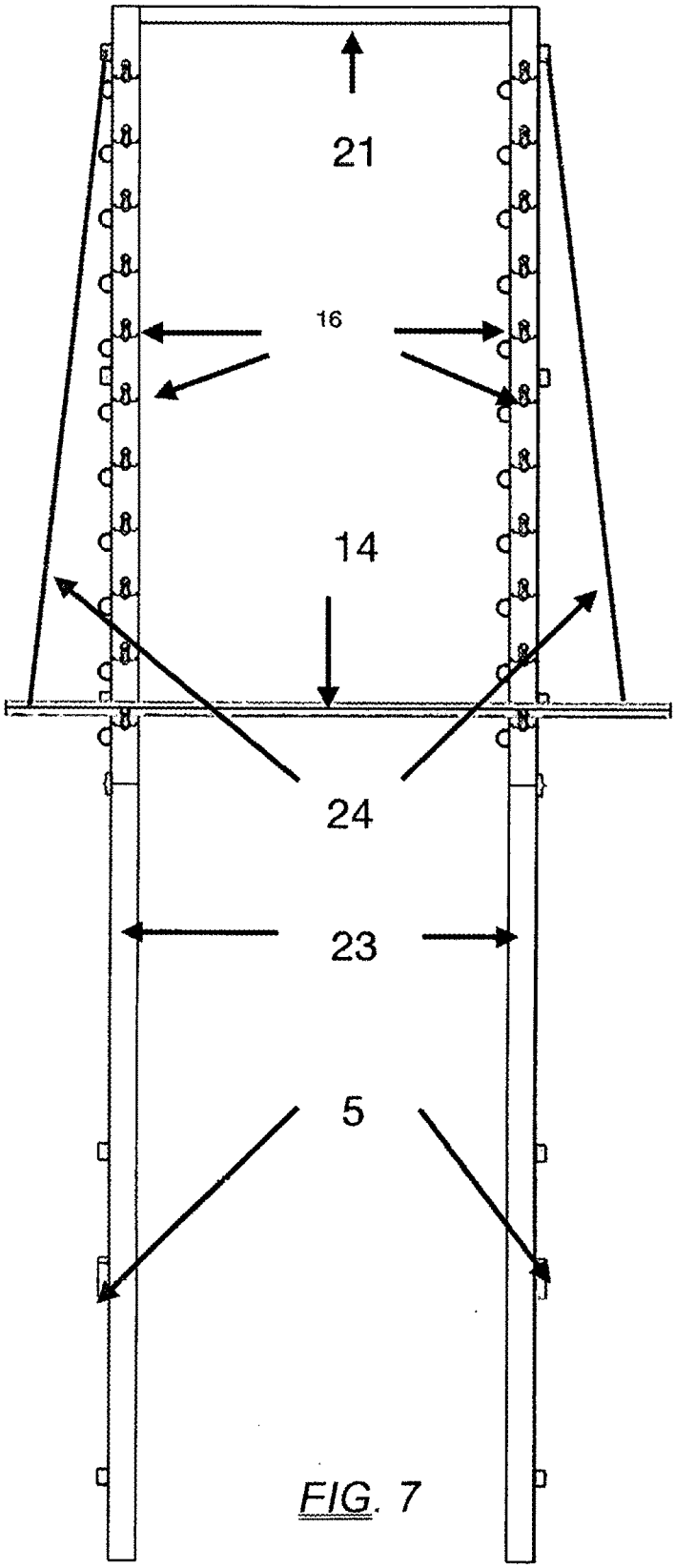
FIG. 7 is a front view of a 12-foot embodiment of the plyometric ladder.

Referring now to FIG. 7, a front view of the 12-foot embodiment is shown. In this embodiment, the removable pegs 16 can be used instead of the spring-loaded arm 2 to allow the athlete to move the pull-up bar 14 up the removable pegs 16, thereby increasing the challenge to the athlete. In this embodiment, the removable pegs 16 can be configured in different intervals to give the athlete the desired challenge.

Figure 8:
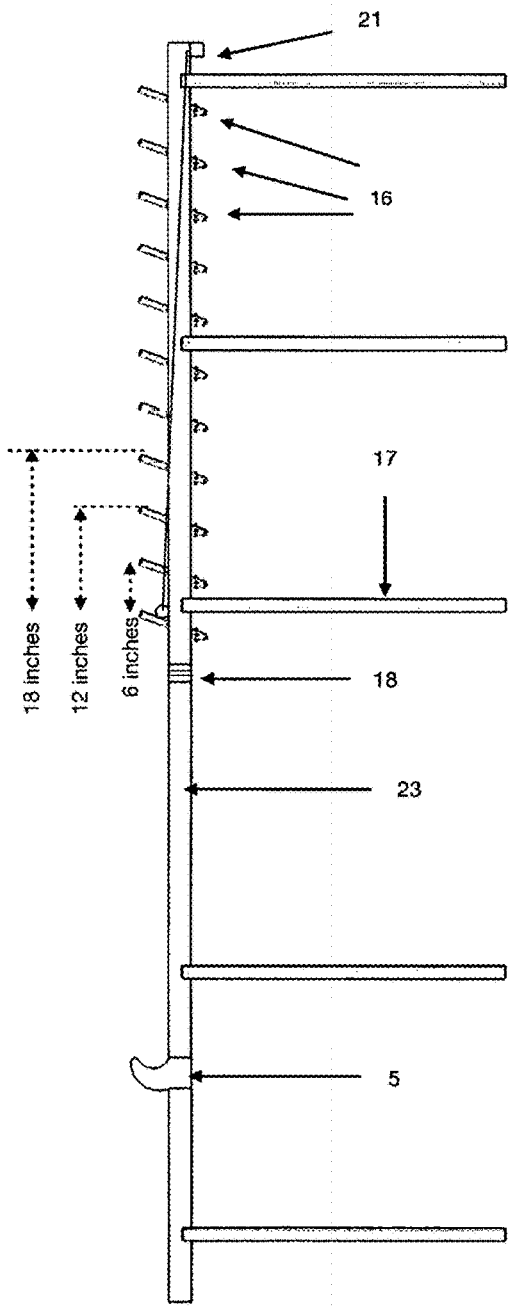
FIG. 8 is a side view of the plyometric ladder shown in FIG. 7.

Referring now to FIG. 8, a side view of the 12-foot embodiment is shown. This view shows the location of a tie bar 21. This view shows the relationship of the fixed brackets 17, locking hinge 18, removable pegs 16, and foot pegs 5. Removable pegs 16 are at placed at a six-inch distance from one another. They can be removed and reconfigured to a 12-inch or 18-inch distance. The tie bar 21 is attached to the top of the frame 1 to connect the two pieces of the frame 1 and make the apparatus sturdier. The tie bar 21 is made from a sturdy, structural steel tubing, hollow to allow the wiring to pass between the two frames 1.

Figure 9:
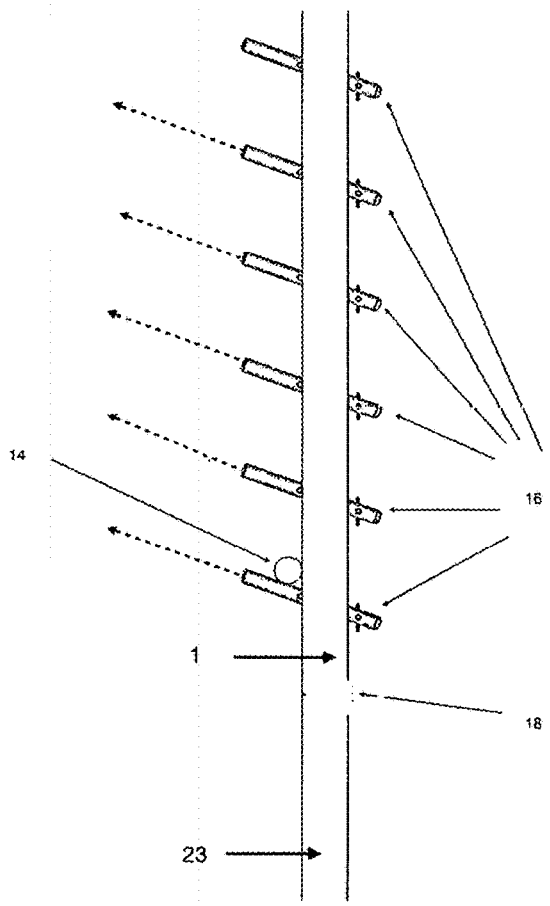
FIG. 9 is an enlarged side view of the plyometric ladder shown in FIGS. 7 and 8.

Referring now to FIG. 9, a close-up side view of the 12-foot embodiment is shown. This view shows the relationship of the removable pegs 16 to one another and how the pull-up bar 14 makes contact with the frame 1 and removable pegs 16. The dotted lines show how the pegs 16 can be removed for different distance configurations. A locking hinge 18 is also shown in position.

The removable pegs 16 in this embodiment are three-quarter diameter, mild steel pegs that are rated to hold up to 300 lbs. The removable pegs 16 hold the pull-up bar 14 and, by default, the athlete. A stop pin 19 prevents each peg 16 from falling out. The removable cotter pin 20 locks it in from the back so it cannot fall out the front. The cotter pin 20 is easily installed or removed by hand.

Figure 10:
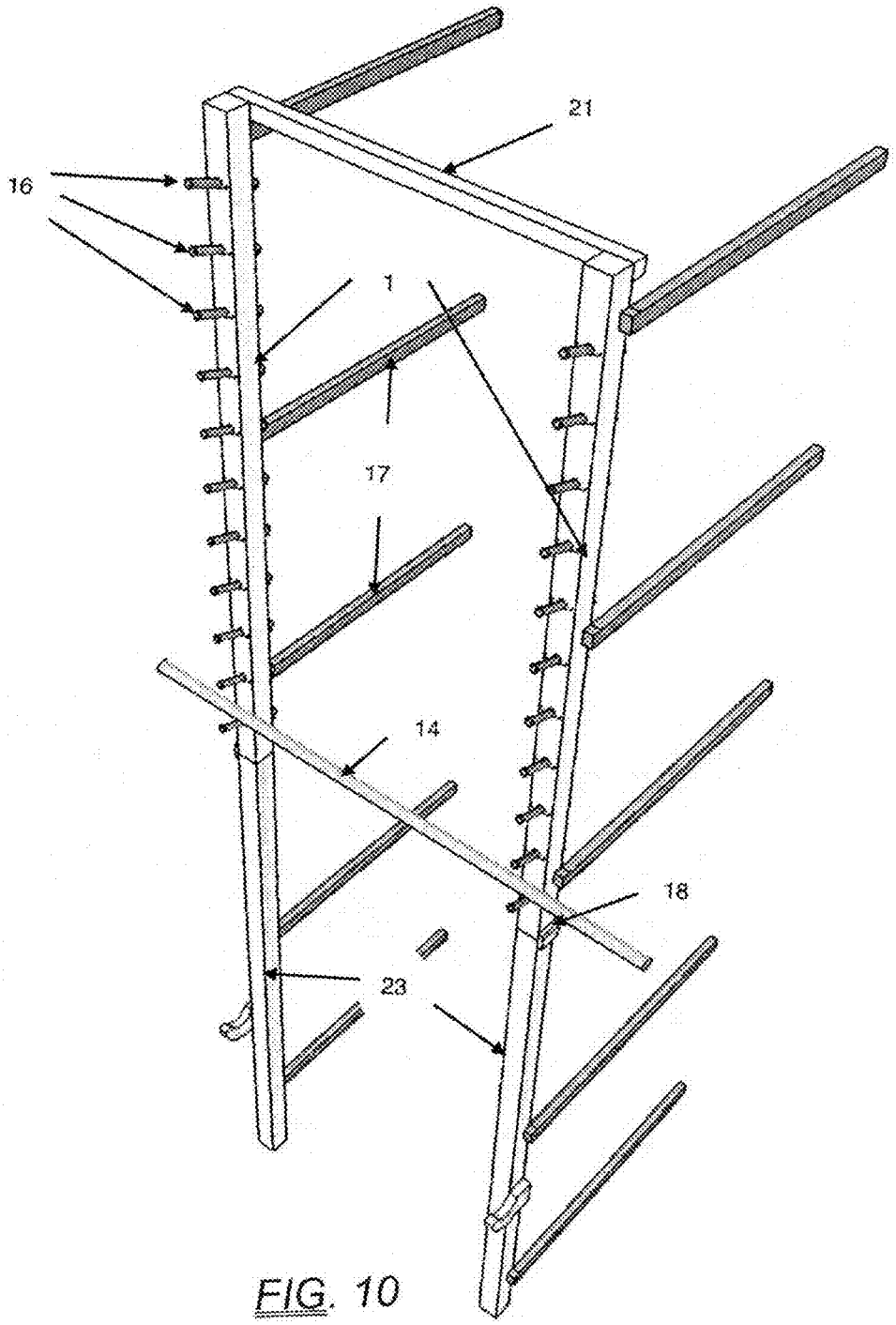
FIG. 10 is a perspective view of the plyometric ladder shown in FIGS. 7-9 with fixed mounting brackets.

Referring now to FIG. 10, a perspective view of the 12-foot embodiment of the ladder is shown with fixed mounting brackets 17. This three-quarter top down view shows the relationship between the frame 1, fixed brackets 17, tie bar 21, removable pegs 16, pull-up bar 14, and locking hinges 18, which are heavy duty hinges that allow the upper and lower halves of the frame to be folded for shipping, setup and storage of the ladder.

Figure 11:
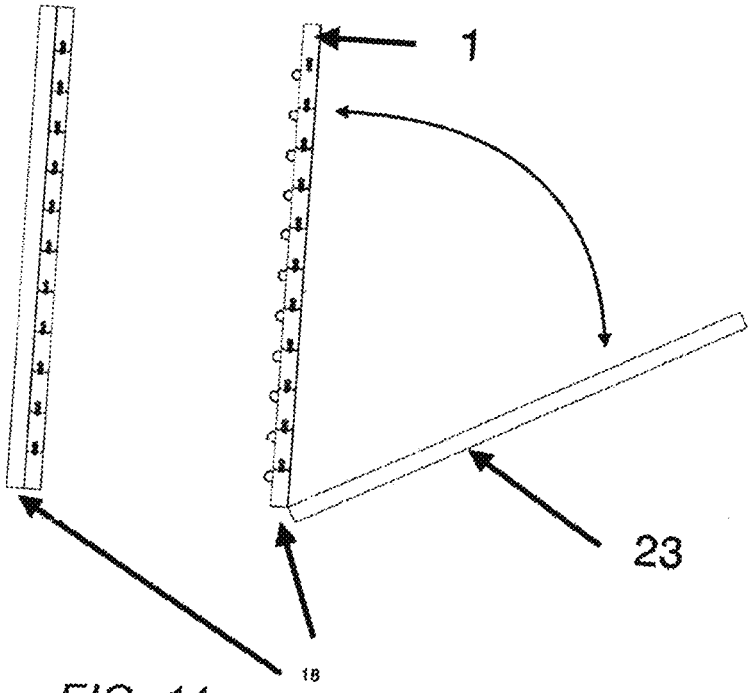
FIG. 11 is a side view of the plyometric ladder shown in FIGS. 7-10, wherein the frames are folded for shipping.

Referring now to FIG. 11, the lower frame 23 and frame 1 are shown folded for shipping, easy setup, and storage. Lower frame 23 comprises a rigid material with a substantially square steel frame. In this first embodiment, the lower frame 23 is made of square structural steel. The lower frame 23 is the bottom half of the 12-foot embodiment. The lower frame 23 uses the locking hinge 18 to fold adjacent to the frame 1 for easy shipping and assembly, due to the locking hinge 18.

Figure 12:
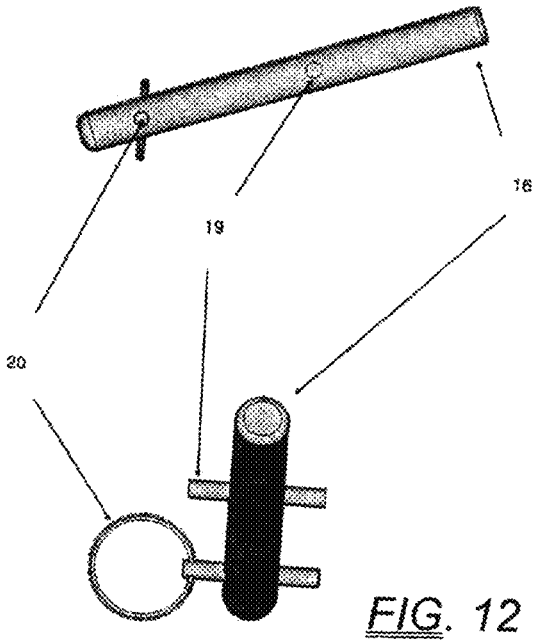
FIG. 12 depicts side and front views of the removable pegs of the plyometric ladder.

Referring now to FIG. 12, side and front views of the removable pegs 16 are shown. The stop pin 19 keeps each peg 16 from falling out of the back of the frame 1, and the cotter pin 20 locks the pin in from the back. The stop pin 19 is a one-eighth inch diameter, hardened dowel pin pressed in the removable peg 16. The cotter pin 20 can be taken out easily by hand to reconfigure the removable pegs 16.

Figure 13:
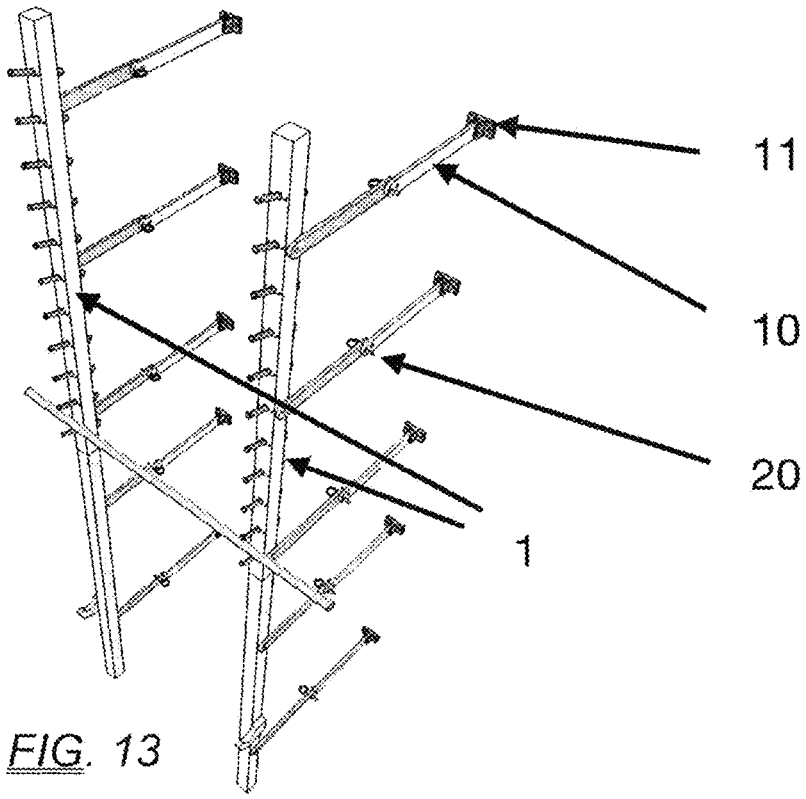
FIG. 13 is a perspective view of the plyometric ladder with scissor arms and wall mounting brackets.

Referring now to FIG. 13, a perspective, three-quarter top down view of the 12-foot embodiment of the ladder is shown with scissor arms 10 and wall mounting brackets 11. This view shows how the cotter pin 20 fits into each scissor arm 10. The removable cotter pin 20 easily slides into removable peg 16 and locks it into place so the removable peg 16 cannot be removed from the front of the frame 1. The cotter pin 20 is meant to be easily installed and removed by hand so that the pegs 16 can quickly and easily be configured for the athlete. The cotter pin 20 is also used in the scissor arms 10 to lock them in position.

Figure 14:
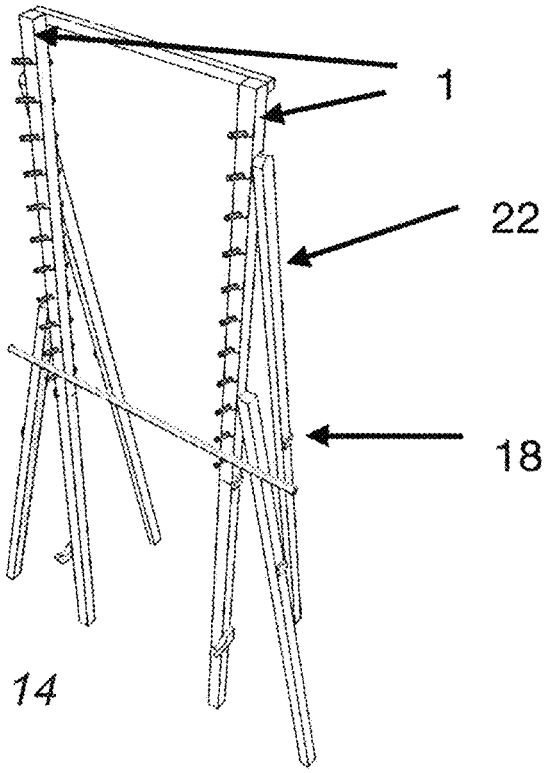
FIG. 14 is a perspective view of the plyometric ladder illustrating the relationship of the frame, freestanding brackets, and locking hinges thereof.

Referring now to FIG. 14, a perspective view of the 12-foot embodiment of the ladder is shown, depicting the relationship of the frame 1 with freestanding brackets 22 and locking hinges 18. The freestanding bracket 22 is composed primarily of a rigid material. In this first embodiment, it is made out of structural tube steel. The freestanding bracket 22 attaches to the frame 1 so the ladder can stand freely without being bolted to a wall or other sturdy structure. The locking hinge 18 is used to fold the legs of the freestanding bracket 22 in half for easy set up and shipping.

Figure 15:
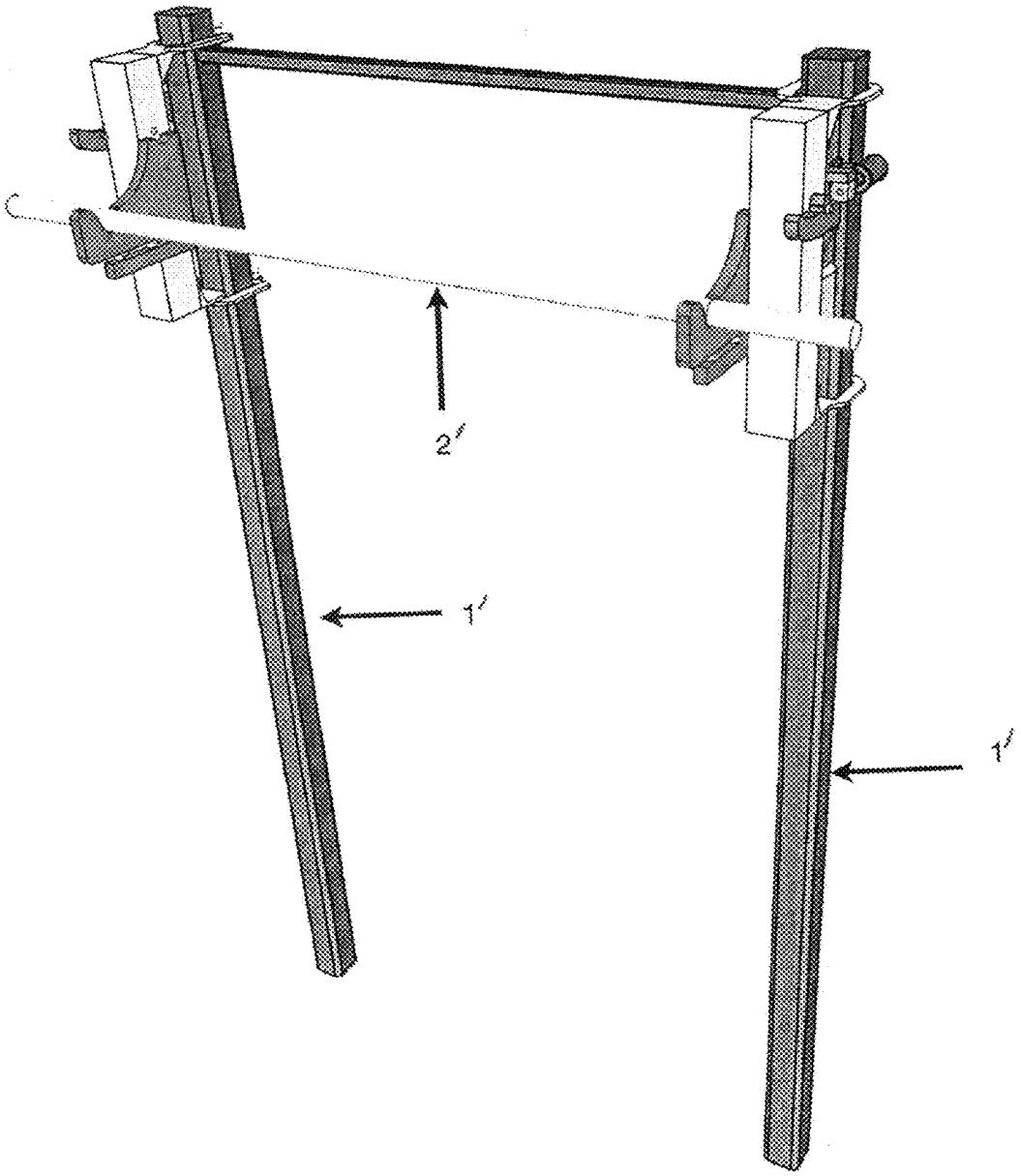
FIG. 15 is a perspective view of a frameless plyometric ladder embodiment in accordance with the present invention.
Figure 16:
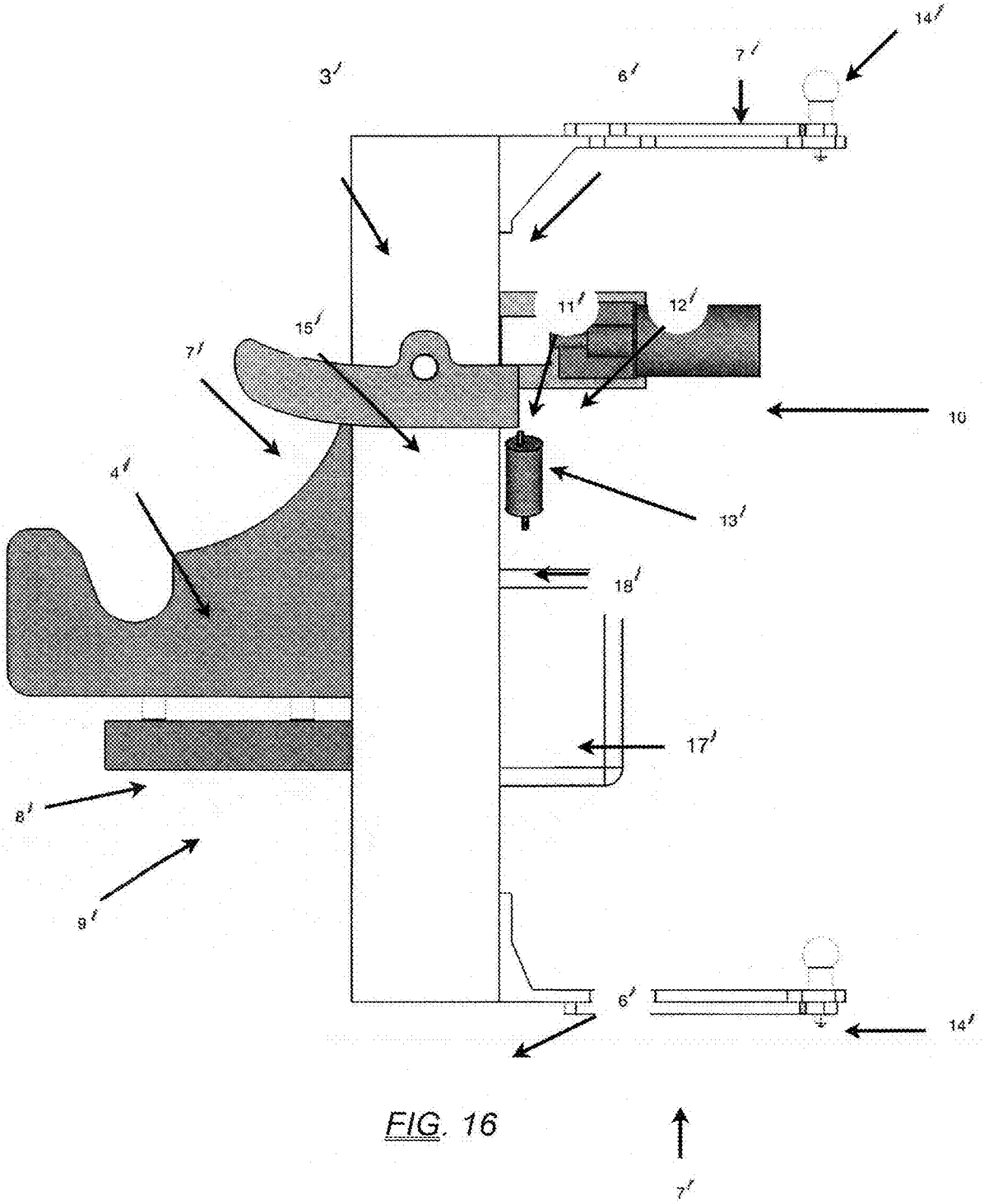
FIG. 16 is a side view of the frameless plyometric ladder shown in FIG. 15.

Referring now to FIG. 15, there is shown a perspective view of another embodiment of the plyometric ladder in accordance with the present invention. In this embodiment, only a skeletal frame is present. It is therefore known as a frameless ladder. Wall brackets are not needed, nor are electromagnets, which are replaced with a 12-volt DC motor 10' and a lever stop 11', supported by a lever bracket 13' (FIG. 16). An existing, commercial squat rack 1' supports a 1½ inch diameter pull-up bar 2'.

Referring now also to FIG. 16, a side view of the frameless plyometric ladder is shown. The motor 10', supported by a motor bracket 12', retracts the lever stop 11' to release the athlete, then replaces the lever stop 11' after a return spring 18' returns a spring lever mounted on axle 15' to its original position. A skeletal aluminum frame 3' of the ladder fits on an existing commercial squat rack 1'. A fixed arm 4' is attached to the skeletal frame 3', as is a lever arm 5'. A shock absorber spring 8' is operationally connected to and supported by a shock absorber base 9'.

An athlete uses the frameless exercise ladder in the same way as described hereinabove with respect to the first embodiment of the present invention. That is, the athlete performs a pull-up on pull-up bar 2' and then hops the bar up while hanging therefrom an adjustable distance, hangs for an adjustable time, then the spring-loaded arm pivots and releases the athlete to ride down the fixed arm 4' to the starting point to begin the cycle again.

Figure 17:
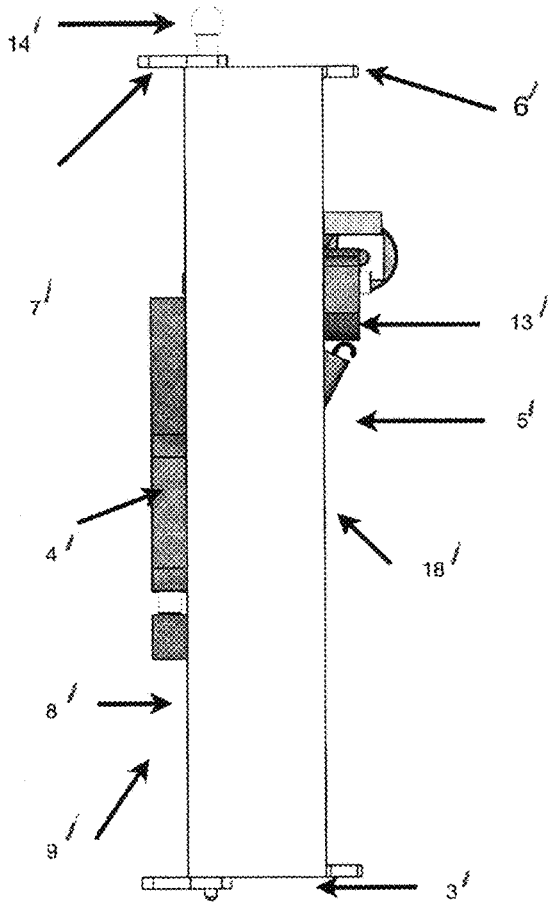
FIG. 17 is a front view of the frameless plyometric ladder.
Figure 18:
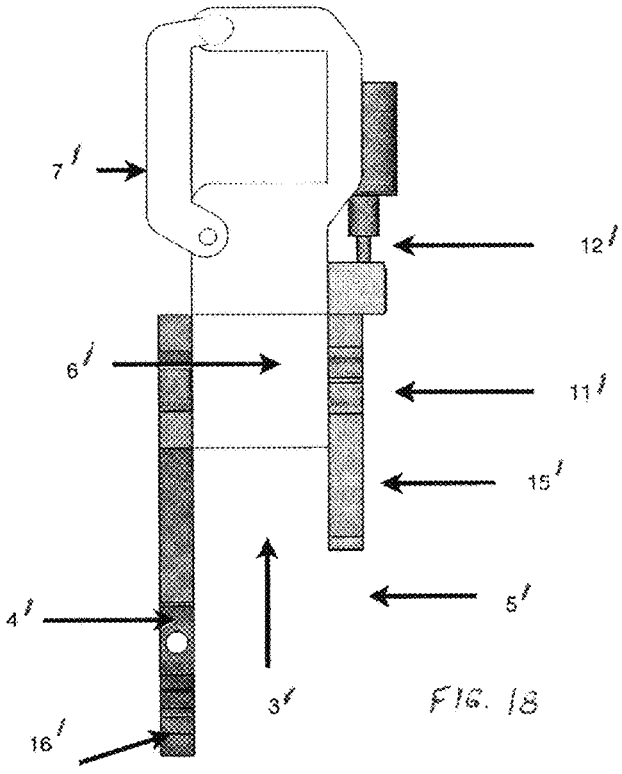
FIG. 18 is a top view of the of frameless plyometric ladder.

Referring now also to FIG. 17, which is a front view of the frameless plyometric ladder, and to FIG. 18, which is a top view of the ladder, bracket clamps 6' are positioned at the top and bottom of skeletal aluminum frame 3' with bracket locking levers 7' attached thereto. At the extremity of the bracket clamps 6' and bracket locking levers 7' are spring-loaded locking pins 14'. A momentary switch 16', electrically connected to an electronic box 17', activates and deactivates the motor 10'.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A plyometric exercise ladder, comprising:

a) a frame comprising two spaced-apart, longitudinal, upright posts, each upright post having an upper portion and a lower portion;

b) fixed arms each having a major axis and being attachable to an existing exercise apparatus, each fixed arm being adjustable along the length thereof;

c) a removable, detachable, unitary pull-up bar having two ends, each end thereof being directly supported, respectively, by at least one of the adjustable fixed arms;

d) two spring-loaded arms, each having a major axis and each disposed above a respective fixed arm and each mounted, respectively, to each fixed arm pivotably around the major axis thereof; and e) an electromagnet operatively connected to each spring-loaded arm for initiating movement thereof relative to the frame.

2. The plyometric exercise ladder in accordance with claim 1, further comprising timing means electrically connected to the means for initiating movement of the spring-loaded arms.

3. The plyometric exercise ladder in accordance with claim 1, further comprising a safety backstop connected to the upper portion of each upright post for preventing the pull-up bar from moving above the frame.

4. The plyometric exercise ladder in accordance with claim 1, further comprising adjustable grips slidably mounted to the pull-up bar.

5. The plyometric exercise ladder in accordance with claim 1, further comprising a safety leash connected to the skeletal frame and to one end of the pull-up bar.

6. The plyometric exercise ladder in accordance with claim 1, further comprising a reed field sensor proximate the spring-loaded arm and electrically connected to the timing means for sensing the proximity of the pull-up bar relative to the spring-loaded arm.

7. The plyometric exercise ladder in accordance with claim 1, further comprising a plurality of spaced-apart foot pegs connected to the lower portion of each upright post.

* * * * *